United States Patent [19]

Menard et al.

[11] Patent Number: 4,879,846

[45] Date of Patent: Nov. 14, 1989

[54] INGOT KNOCK OUT AND GRIND MACHINE

[75] Inventors: Alan W. Menard, Bolton; Clifford B. Turner, East Hampton, both of Conn.

[73] Assignee: United Technologies Corporation, Hartford, Conn.

[21] Appl. No.: 226,349

[22] Filed: Jul. 29, 1988

[51] Int. Cl.[4] ..... B24B 21/00

[52] U.S. Cl. ..... 51/137; 51/139; 164/131; 249/66.1

[58] Field of Search ..... 51/137, 142, 139, 34 C, 51/34 D, 38, 39, 48 R, 49, 66, 145 R, 144; 164/131; 249/66.1, 67, 68

[56] References Cited

U.S. PATENT DOCUMENTS

| | | | |
|---|---|---|---|
| 2,857,639 | 10/1958 | Johnston | 164/131 |
| 3,101,577 | 8/1963 | Skugghall | 51/139 |
| 3,597,881 | 10/1971 | Olton et al. | 51/66 |
| 4,794,979 | 1/1989 | Gassner et al. | 164/469 |

*Primary Examiner*—Frederick R. Schmidt
*Assistant Examiner*—Maurina Rachuba
*Attorney, Agent, or Firm*—Edward L. Kochey, Jr.

[57] ABSTRACT

A vertically adjustable support frame (10) with chain clamps (12) supports a mold (14) containing an ingot (16) in alignment with a ram cylinder (18). Rolls (34) receive the ingot and transfer it to rolling rolls (38). A belt grinder (46) traverses the length of the rotating ingot to grind the circumference.

1 Claim, 3 Drawing Sheets

INGOT KNOCK OUT AND GRIND MACHINE

TECHNICAL FIELD

The invention relates to vacuum cast ingots and in particular to a knock out and grind machine therefor.

BACKGROUND OF THE INVENTION

Alloy metal ingots are vacuum cast in permanent cylindrical molds with the ingots later use in electron beam and induction melting furnaces. Surface irregularities form on the circumference of the ingots caused by splashing or other contaminants in the interior of the mold. On removal of the ingot from the mold, these surface irregularities persist. If allowed to remain thereon, the ingot will pick up dirt during storage and handling, thereby contaminating the alloy going subsequent melt in the electric arc furnace.

Accordingly, a coordinated apparatus is desirable to knock out the ingot from the mold and grind the circumference of the ingot to remove irregularities without unnecessary handling of the ingot.

SUMMARY OF THE INVENTION

A support frame for horizontally supporting an ingot mold containing an ingot includes hold down means secure to the support frame and engageable with the ingot mold for rigidly securing the mold. A hydraulic ram cylinder is coaxially aligned with the supported ingot mold with actuating means for operating the ram to push the ingot from the mold. A plurality of receiving rolls are adjustable to be place in substantial alignment with the ingot mold for receiving the ingot when pushed from the ingot mold. A plurality of pairs of rolling rolls are also located in substantial alignment with the ingot mold for supporting and rolling the ingot after it has been transferred from the receiving rolls to the rolling rolls, preferably by lowering the receiving rolls. A belt grinder is located to traverse along the ingot with the ingot rolling on the rolling rolls to grind the circumference of the ingot.

DESCRIPTION OF THE PREFERRED EMBODIMENT

Figure 2:
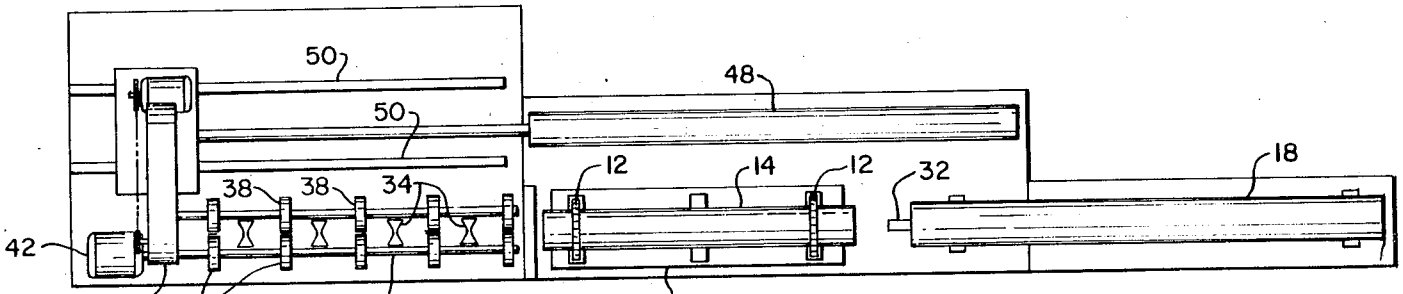
FIG. 2 is a plan view of the machine.
Figure 1:
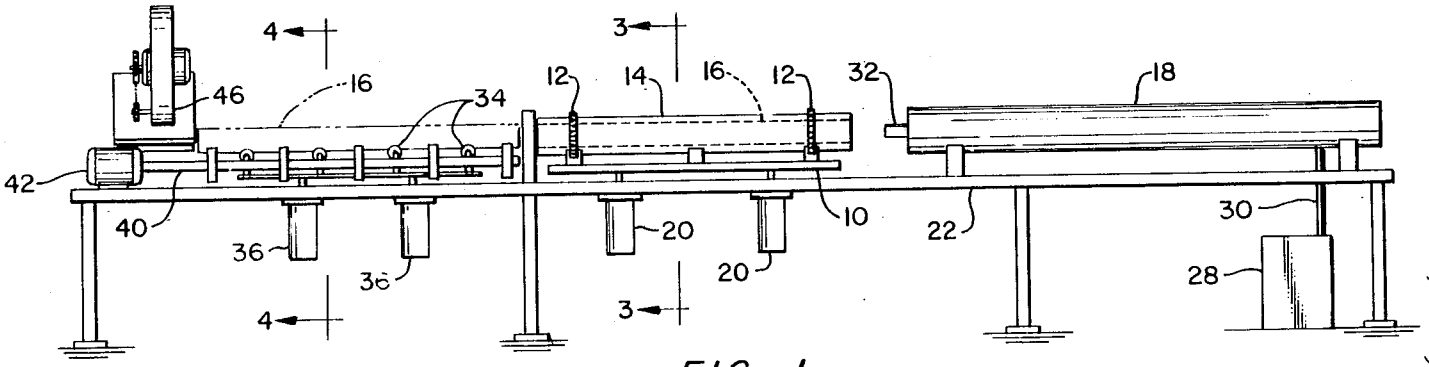
FIG. 1 is a side elevation of the ingot knock out and grind machine.
Figure 3:
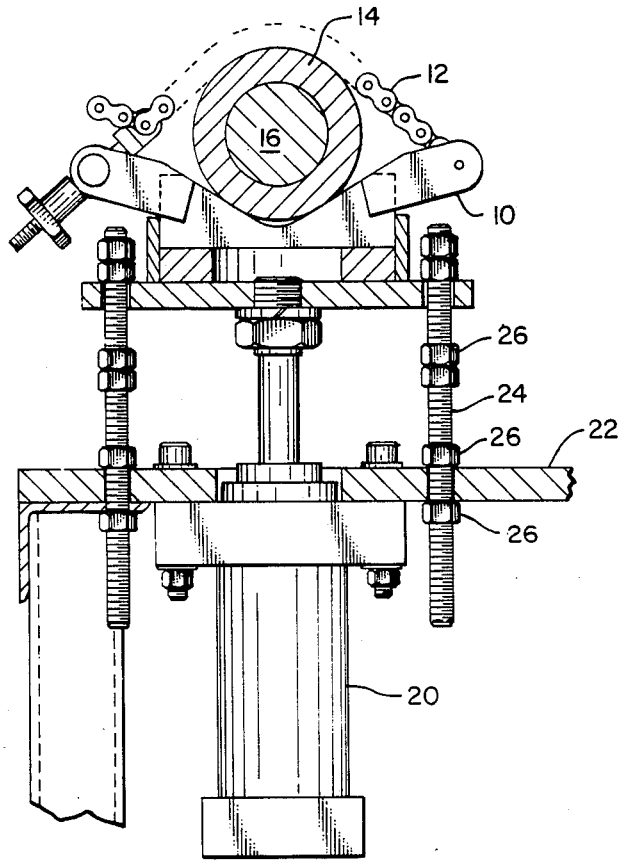
FIG. 3 is a section showing the ingot hold down means.
Figure 4:
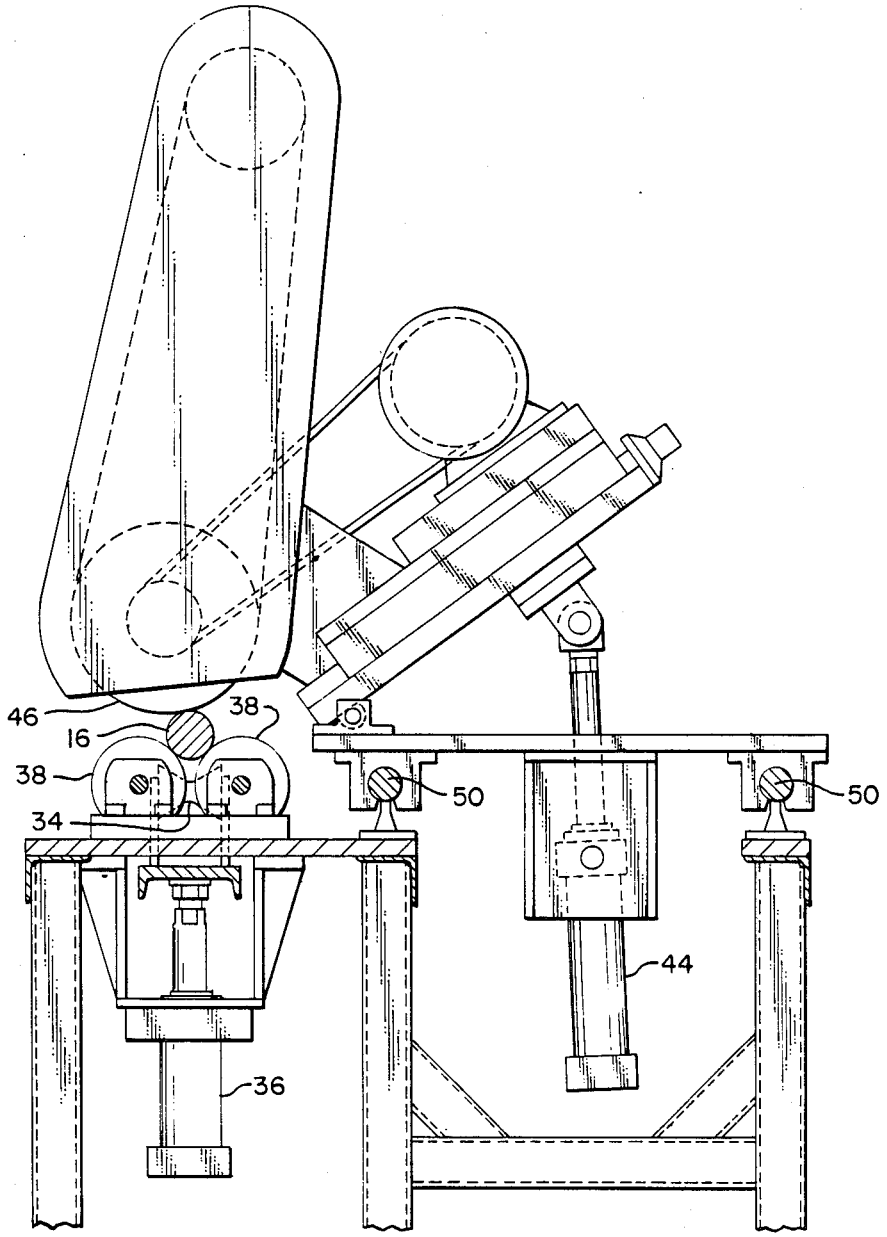
FIG. 4 is a section showing the belt grinder and the rolling rolls.

Support frame 10 includes adjustable length chain clamps 12.

These are operative to engage and rigidly secure an ingot mold 14 containing an as cast ingot 16.

A hydraulic ram cylinder 18 is coaxially aligned with a supported ingot mold. Adjustment cylinders 20 are connected between the machine structure 22 and the support frame 10 for vertically moving a supported ingot mold into proper coaxial alignment with the ram cylinder. Support check bolts 24 and support check nuts 26 are adjusted to permit free movement within a desired range, but to provide rigidity to the support frame when it is in position for the ingot knock out operation.

An actuating means 28 including a high pressure hydraulic supply and return mechanism provides a means for sending hydraulic fluid through line 30 to actuate the ram cylinder 18. On actuation of this cylinder, knock out ram 32 is extended pushing ingot 16 out of the mold 14. In operation, this ram is operated to initially push the ingot out only part way, for instance 12 inches.

At this time the plurality of receiving roles 34 in the form of double conical rollers are placed in substantial longitudinal alignment with the ingot mold through operation of ingot support cylinders 36. As the ingot is further pushed out, it rests on and rides on the support rollers. The ram may now be retracted and the ingot mold removed now or later as desired.

A plurality of pairs of rolling rolls 38 are rotatable by shaft 40 driven by motor 42. These rolls are located also in substantial longitudinal alignment with the ingot mold. The ingot is transferred from the receiving rolls to the rolling rolls by actuation of support cylinders 36 lowering the ingot until it rests on the rolling rolls. Operation of motor 42 then causes the ingot to roll on the rolling rolls.

A belt grinder 46 is adjustable with cylinder 44 permitting the belt 46 to come in contact with the outer circumference of the ingot 16. A grinder traversing means 48 is operatively connected to the grinder with this traversing means being in the form of a hydraulic cylinder for traversing the grinder along tracks 50. In making this endless belt will grind the outer circumference of the ingot while it is being rolled. One or more passes may be made as required to obtain the desired surface smoothness.

Knock-out ram 32 also has provision for replacing the ram head with a round brush for cleaning the ingot mold interior after ingot removal.

I claim:

1. An ingot knock out and grind machine comprising:

a support frame for horizontally supporting an ingot mold containing an ingot;

hold down means secured to said frame and engageable with said ingot mold for rigidly securing said mold to said support frame;

hydraulic ram cylinder coaxially aligned with a supported ingot mold;

knock out actuating means for actuating said ram cylinder for pushing said ingot from said mold;

a belt grinder traversable along said ingot when said longitudinal alignment with said ingot mold for receiving said ingot from said ingot mold;

a plurality of pairs of rolling rolls also located in substantial longitudinal alignment with said ingot mold for supporting and rolling said ingot;

transfer means for transferring said ingot from said receiving rolls to said rolling rolls comprising hydraulic support cylinders for raising and lowering said receiving roles with respect to said rolling rolls;

a belt grinder traversable along said ingot when said ingot is on said rolling rolls;

traversing means for traversing said belt grinder along said ingot for grinding the circumference of said ingot; and adjustment cylinders connected to said support frame for vertically aligning a supported ingot mole with said hudraulic ram cylinder.

* * * * *

UNITED STATES PATENT AND TRADEMARK OFFICE

CERTIFICATE OF CORRECTION

PATENT NO. : 4,879,846

DATED : November 14, 1989

INVENTOR(S) : ALAN W. MENARD, CLIFFORD B. TURNER

It is certified that error appears in the above-identified patent and that said Letters Patent is hereby corrected as shown below:

Claim 1, Column 2, Line 48, cancel the entire line and substitute with -- a plurality of receiving rolls located in substantial --

Claim 1, Column 2, Line 65, "mole" should be --mold--

Claim 1, Column 2, Line 66, "hudraulic" should be --hydraulic--

Signed and Sealed this

Fifth Day of May, 1992

*Attest:*

DOUGLAS B. COMER

*Attesting Officer*

*Acting Commissioner of Patents and Trademarks*